United States Patent [19]

Fujita et al.

[11] Patent Number: 4,635,574

[45] Date of Patent: Jan. 13, 1987

[54] AUTOMATIC SEWING APPARATUS

[75] Inventors: Jiro Fujita; Iwao Yamane, both of Aichi, Japan

[73] Assignee: Mitsubishi Denki Kabushiki Kaisha, Tokyo, Japan

[21] Appl. No.: 779,901

[22] Filed: Sep. 25, 1985

[30] Foreign Application Priority Data

Sep. 28, 1984 [JP] Japan ..... 59-203139
Sep. 28, 1984 [JP] Japan ..... 59-203140

[51] Int. Cl.[4] ..... D05B 21/00
[52] U.S. Cl. ..... 112/121.12; 112/155
[58] Field of Search ..... 112/121.12, 121.11, 112/121.14, 121.29, 121.15, 103, 262.1, 262.3, 155, 2, 311

[56] References Cited

U.S. PATENT DOCUMENTS 4,089,279 5/1978 Hess et al. ..... 112/121.12
4,305,338 12/1981 Adamson ..... 112/121.12 X
4,337,881 7/1982 Off et al. ..... 112/121.15 X
4,425,858 1/1984 Hargett ..... 112/121.15 X

*Primary Examiner*—Peter Nerbun
*Attorney, Agent, or Firm*—Sughrue, Mion, Zinn, Macpeak and Seas

[57] ABSTRACT

An automatic sewing apparatus in which automatic sewing operations can be performed merely upon placing cassettes into which have been loaded cloth pieces to be sewn onto a first carrier unit and in which a variety of sewing operations can be performed. The apparatus includes plural sewing machines, each having a table movable according to a programmed sewing pattern, with the cassettes being receivable on this table. The first carrier units transport the cassettes in a predetermined direction, while second carrier units transport the cassettes received from the first carrier unit to corresponding ones of the sewing machines. The various sewing machines perform predetermined designated sewing operations on the cloth pieces held in the cassettes.

18 Claims, 28 Drawing Figures

AUTOMATIC SEWING APPARATUS

BACKGROUND OF THE INVENTION

The present invention relates to an automatic sewing apparatus.

In manufacturing bags, shoes and clothes etc., it is usually necessary to sew cloth pieces to a main cloth portion constituting a product body. In such case, it has been usual to manually put the cloth pieces on the main cloth portion, set them in a sewing machine, and move the latter according to a predetermined pattern. This procedure is troublesome and requires the considerable labor of an operator.

On the other hand, it has been proposed recently an electronic pattern sewing machine in which the main cloth portion and cloth pieces are mounted on a table which is movable in X and Y directions and the table is automatically moved according to a predetermined, programmed pattern stared in a PROM.

In such automatic apparatus, however, the operator has to stack the cloth and cloth pieces on the table and set them together, which is not only still troublesome, but also a source of quality variation due to possible relative movements of the cloth pieces to the cloth.

SUMMARY OF THE INVENTION

Therefore, an object of this invention is to provide an automatic sewing apparatus capable of automatically performing these sewing operations without the above-mentioned drawbacks.

Satisfying this and other objects, an automatic sewing apparatus, according to this invention, comprises a cassette for positioning and holding materials to be sewn, the cassette being provided with a determination portion, a table for mounting the cassette thereon, the table being movable according to a program of a sewing pattern; a plurality of units arranged in series, each of the units comprising a sewing machine from sewing the materials held by the cassette, a first carrier unit for transporting the cassette in a downstream direction and a second carrier unit disposed at an end of the first carrier unit for moving the cassette to the sewing machine for sewing the materials thereon and for carrying away the cassette from the sewing machine after a sewing operation terminates, sewing pattern programs of the respective units being different from each other so that a plurality of sewing steps can be carried out determination means provided in the carrier unit to identify the determination portion of the cassette, the second carrier unit positioning the cassette in the sewing machine according to an output of the determination means and a controller for controlling the respective units.

When a cassette is put into the first carrier unit, the materials in the cassette are sewn by the sewing machine according to the output of the determination means, and the the cassette is carried to the downstream side by the second carrier unit. The cassette transported by the first carrier unit is subjected to a sewing operation by the sewing machine, and then transported in the downstream direction by the second carrier unit. By repeating these operation, multiple sewing operations are performed by the sewing machine.

The operations of the above-described components are controlled by the controller.

DESCRIPTION OF THE PREFERRED EMBODIMENTS

Preferred embodiments of an automatic sewing apparatus constructed according to the present invention will be described.

Figure 1:
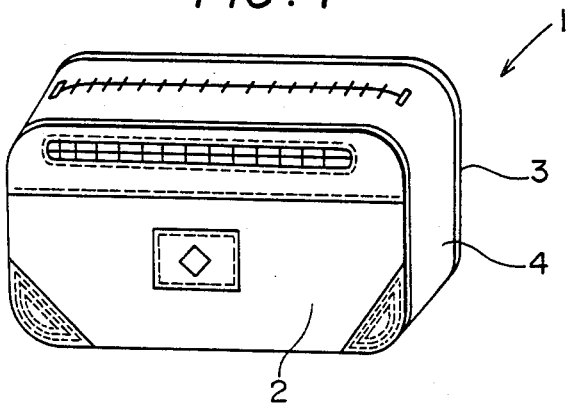
FIG. 1 is a perspective view of a bag to be manufactured by sewing.
Figure 2:
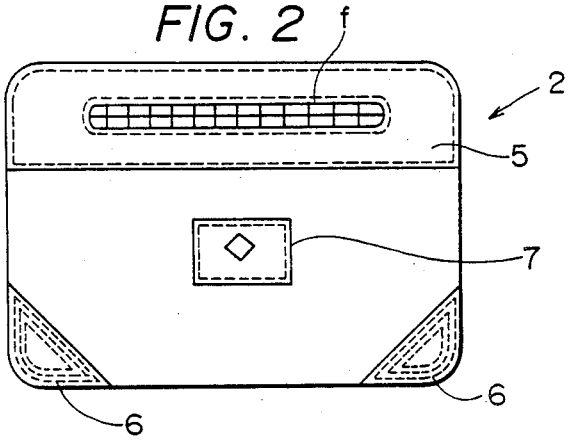
FIG. 2 is a front view of the bag.
Figure 3:
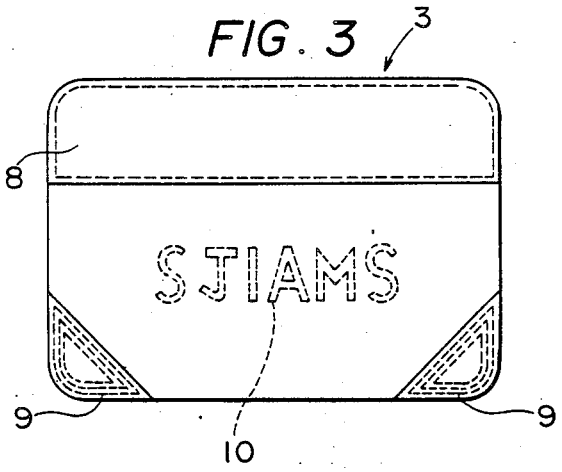
FIG. 3 is a rear side view of the bag.

FIG. 1 shows a bag 1 which is a to be sewn. The bag 1 is constituted by a rectangular front side cloth piece 2, a back side cloth piece 3 having the same contour as that of the front side cloth piece 2, and a ringed side cloth piece 4 connecting the cloth pieces 2 and 3 by sewing. Onto the front side cloth piece 2 a substantially rectangular cloth piece 5, substantially triangular cloth pieces 6 and a substantially square label 7 are attached by sewing, and a fastener f is attached to the cloth piece 5 by sewing, as shown in FIG. 2. Onto the back side cloth piece 3, a substantially rectangular cloth piece 8 and substantially triangular cloth pieces 9 are sewn, and decorative stitches 10 are formed, as shown in FIG. 3.

Figure 4:
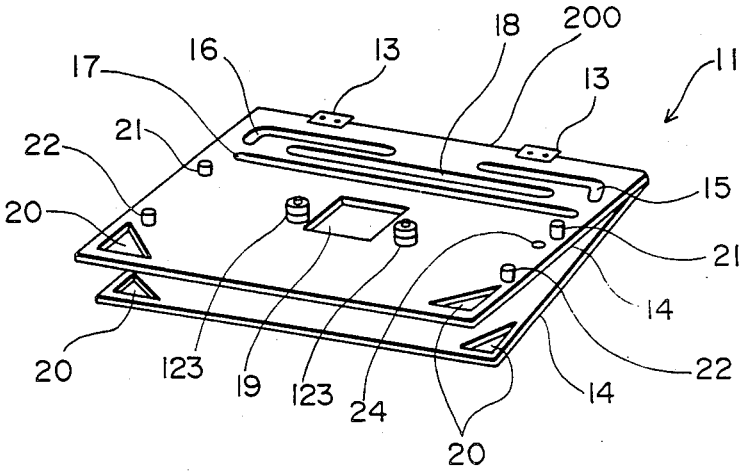
FIG. 4 is a perspective view of a cassette for a front side cloth piece.
Figure 5:
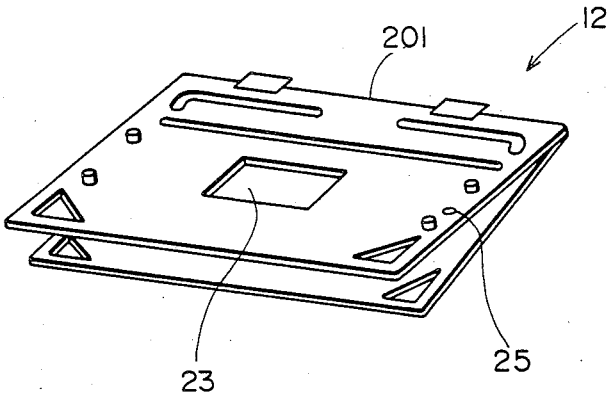
FIG. 5 is a perspective view of a cassette for a back side cloth piece.

The pieces 5, 6, 8, 9, the fastener 5, the label 7 and the stitches 10 are sewn on the cloth pieces 2 and 3 by the automatic sewing apparatus to be described, while the cloth pieces 2 and 3 are held by a cassette 11 for the front side cloth piece and a cassette 12 for the back side cloth piece, as shown in FIGS. 4 and 5, respectively.

The cassette 11 for the front side cloth piece 2, which is composed of a pair of plates 14 hinged on one side thereof by a pair of hinges 13, is usually kept closed by a switchable device such as springs or magnets so that they can be operated selectively. The plates 14 are formed with long slots 15, 16 and 17 and a long slot 18 corresponding, in position and contour, to sewing lines of the cloth piece 5 and the fastener f, respectively, and with a label mounting hole 19 and cloth piece mounting holes 20 corresponding, in position and contour, to the label 7 and the cloth pieces 6, respectively. The cloth pieces 6 are mounted manually on the holes 20 after the plates 14 are closed. The label 7 is automatically supplied onto the hole 19 by a label supply device shown in FIGS. 19 to 22. Two pairs of protrusions 21 and 22 are formed in opposite sides of an outer surface of one of the plates 14.

The cassette 12 for the back side cloth piece 3 is substantially the same as the cassette 11, except that the cassette 12 has no long slot 18 and hole 19 while it has a slot 23 for the decorative stitches 10. That is, the sewing operation to be done for the back side cloth piece 3 includes the step of sewing the stitches 10 but not the sewing steps for the fastener f and the label 7.

The cassette 11 has a detection hole 24, while the cassette 12 has a detection hole 25 in a slightly different position from that of the hole 24, as shown in FIG. 5. The cassettes 11 and 12 are distinguished from each other by detecting the position of the detection hole. The holes 24 and 25 constitute identifying portions of the cassette 11 and 12, respectively.

The inventive automatic sewing apparatus will now be described.

Figure 6:
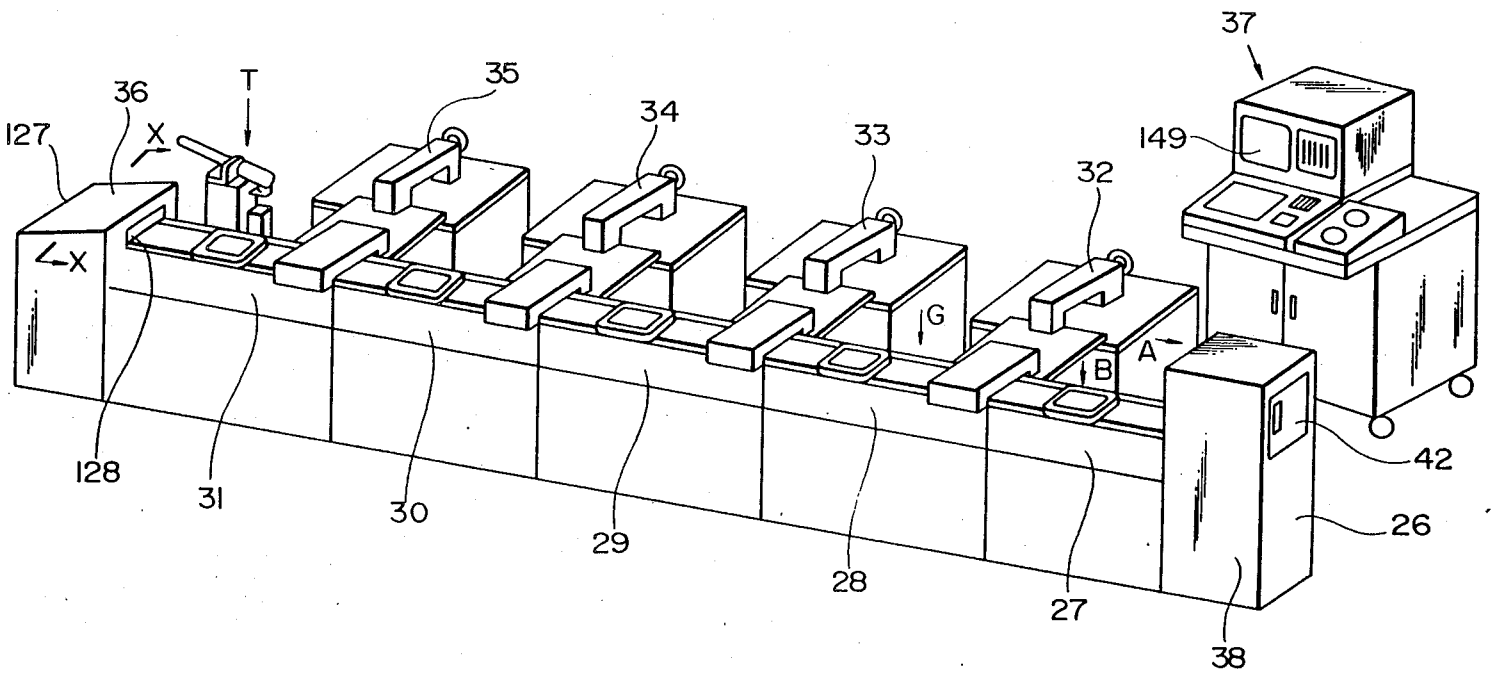
FIG. 6 is a perspective view showing the overall arrangement of an automatic sewing apparatus of the invention.

The automatic sewing apparatus, as shown in FIG. 6, includes a storing unit 26 into which a plurality of the cassettes 11 or cassettes 12 are inserted manually and stored, a take-out unit 27 for extracting the cassettes stored in the storing unit 26 one by one, a plurality (four) of carrying devices 28, 29, 30 and 31 arranged in series for carrying the extracted cassettes successively in a downstream direction, a corresponding number of electronic sewing machines 32, 33, 34 and 35 provided in the respective carrying devices and each having a program of a predetermined sewing operation to be carried out in the corresponding carrying device, a recovering unit 36 for recovering and storing the cassettes 11 or 12 the sewing operations for which are completed, and a controller 37 for controlling the electronic sewing machines 32 to 35, the respective units 26, 27 and 35 and the carrying devices 28 to 31 and controlling the used cassettes 11 or 12.

Figure 7:
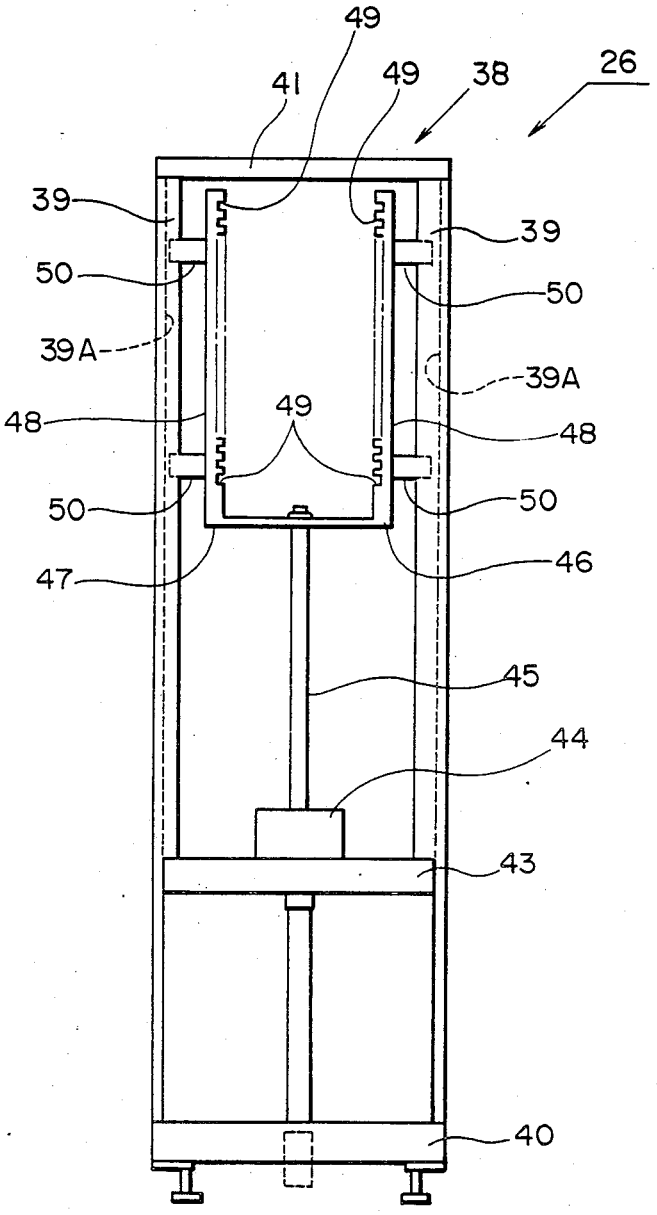
FIG. 7 is a front view of a mounting unit as seen in the direction of an arrow A in FIG. 6.

The storing unit 26 is shown in FIG. 7, which is a front view as seen in the direction of an arrow A in FIG. 6.

In FIG. 7, reference numeral 38 depicts a support frame having a pair of opposed side plates 39, a bottom plate 40, a top plate 41 and a door 41 disposed at a rear side of the unit as shown in FIG. 6, the front side being opened. A vertically extending guide groove 39A is formed in an inner surface of each of the side plates 39 with the guide grooves 39A facing each other. A mounting base plate 43 is arranged in a lower portion of the unit 26, and a driving portion 44 is mounted thereon.

From the driving portion 44, a drive shaft 45 extends vertically upwardly. The drive shaft 45 is driven by the driving portion 44 in such a way that it is retracted downwardly steppingly, with an increment corresponding to the thickness of the cassette 11 or 12, and extending upwardly through its complete stroke.

The cassettes are stored in a cassette storing portion 46 provided on a top end of the drive shaft 45. The cassette storing portion 46, which includes a bottom plate 47 mounted on the top end of the drive shaft 45 and a pair of side plates 48 extending upwardly from opposite side portions of the bottom plate 47, has generally the form of the letter U. In an inner surface of each side plate 48 are formed a plurality of horizontally extending cassette holding grooves 49, and each cassette is supported slidably by the cassette holding groove 49 in one of the side plates 48 and the corresponding cassette holding groove 49 in the other side plate 48. The lowest grooves 49 are positioned at a level spaced slightly apart from the bottom plate 47. The cassettes 11 and 12 and inserted into the respective pairs of the holding grooves 49 through a door 42 on the frame 38. A plurality of guide pieces 50, formed on the outer surface of the side plates 48 of the cassette storing portion 46, fit slidably in the guide grooves 39A of the support frame 38 so that the cassette storing portion 46 can be reciprocated vertically along the guide grooves 39A by the drive portion 44.

Figure 8:
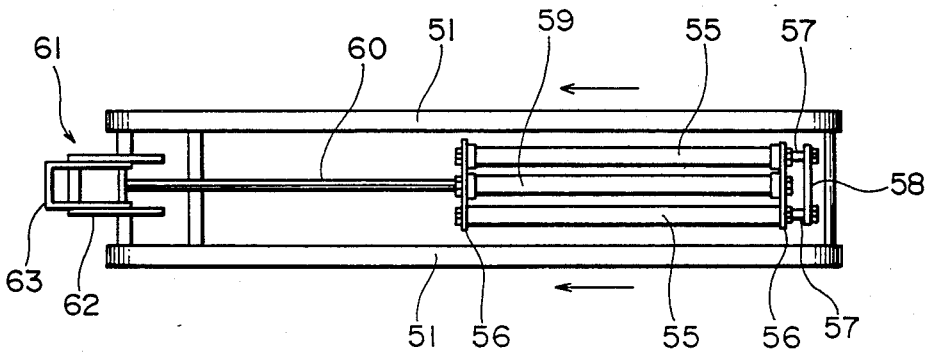
FIG. 8 is a front view of a extracting unit as seen in the direction of an arrow B in FIG. 6.
Figure 9:
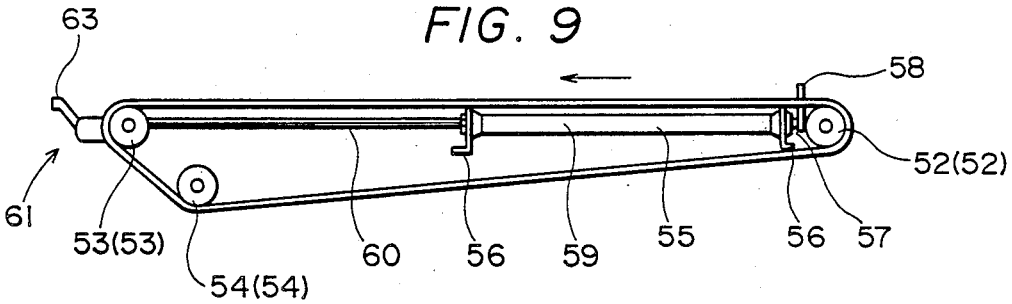
FIG. 9 is a bottom view of the extracting unit in FIG. 8.
Figure 10:
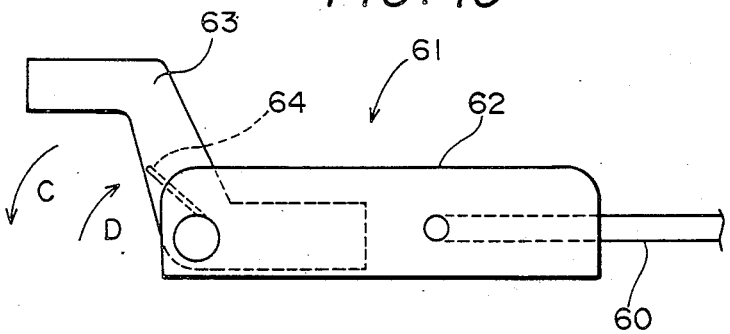
FIG. 10 is an enlarged view of a portion of the unit of FIG. 9.

The cassette extracting unit 27 is shown in FIG. 8 to 10, of which FIG. 8 is a front view as seen in the direction of an arrow B in FIG. 6, FIG. 9 is a side view, and FIG. 10 is an enlarged view of a portion shown in FIG. 9.

In these figures, reference numeral 51 depicts conveyer belts running in directions indicated by arrows through a pair of pulleys 52 provided in the vicinity of the front side of the storing unit 26, a pair of pulleys 53 provided downwardly of the pulley, 52 and driving pulleys 54.

Further, reference numeral 55 depicts air cylinders arranged between the conveyer belts 51 in parallel thereto. The air cylinders 55 are supported by fixing pieces 56.

The air cylinders 55 have rods 57 which are retractably extended toward the storing unit 26 and have top ends formed with an engaging piece 58 protruding upwardly from respective one of the belts 51. The rods 57 extend up to the interior of the storing unit 26 when extended completely, with the engaging piece 58 at the top ends thereof being engaged with the rear end surface of the cassette stored in the lowest level in the storing unit 26. When the rods 57 are retracted completely, the top ends thereof are positioned at the downstream side of the pulleys 52.

The rods 57 are extended by operating a switch (not shown) and their movements are ganged with the operation of the driving portion 44 of the storing unit 26 in such a way that, when the rods are extended completely, the driving portion 44 is actuated to lower the cassette holding portion 46 by an increment corresponding ot the thickness of the cassette 11 or 12. The rods are retracted after the cassette holding portion 46 is lowered. Therefore, it is possible to supply the cassettes 11 and 12 one by one to the conveyer belts 51 in response to reciprocation of the rods 57.

Reference numeral 59 depicts an air cylinder supported by the fixing pieces 56 parallel to and operating when actuated in the opposite direction to the cylinders 55 so that a rod 60 can reciprocate in opposite directions. The rod 60 has at a top end thereof, a pusher portion 61. The pusher portion 61 is composed of a bracket 62 mounted on the top end of the rod 60, a pushing member 63 supported by the bracket 62 rotatably in the direction of an arrow C, and a biasing spring 64 for biasing the pushing member 63 in direction of an arrow D. The pushing member 63 has a top end portion protruding from the level of the conveyer belts 51.

The rod 60 of the air cylinder 59, which is normally in a retracted state, is extended in synchronism with the positioning of a cassette 11 or 12 on the conveyer belts 51. That is, the rod 60 starts to extend when a sensor (not shown) detects that a cassette has passed over the pushing member 63, rotated thereby in the direction C, and has reached the downstream end of the conveyer belts 51 to thereby push the cassette further.

The sewing machines 32 to 35 have their own sewing programs stored in memories such as PROMs. The programs are different from each other.

Figure 11:
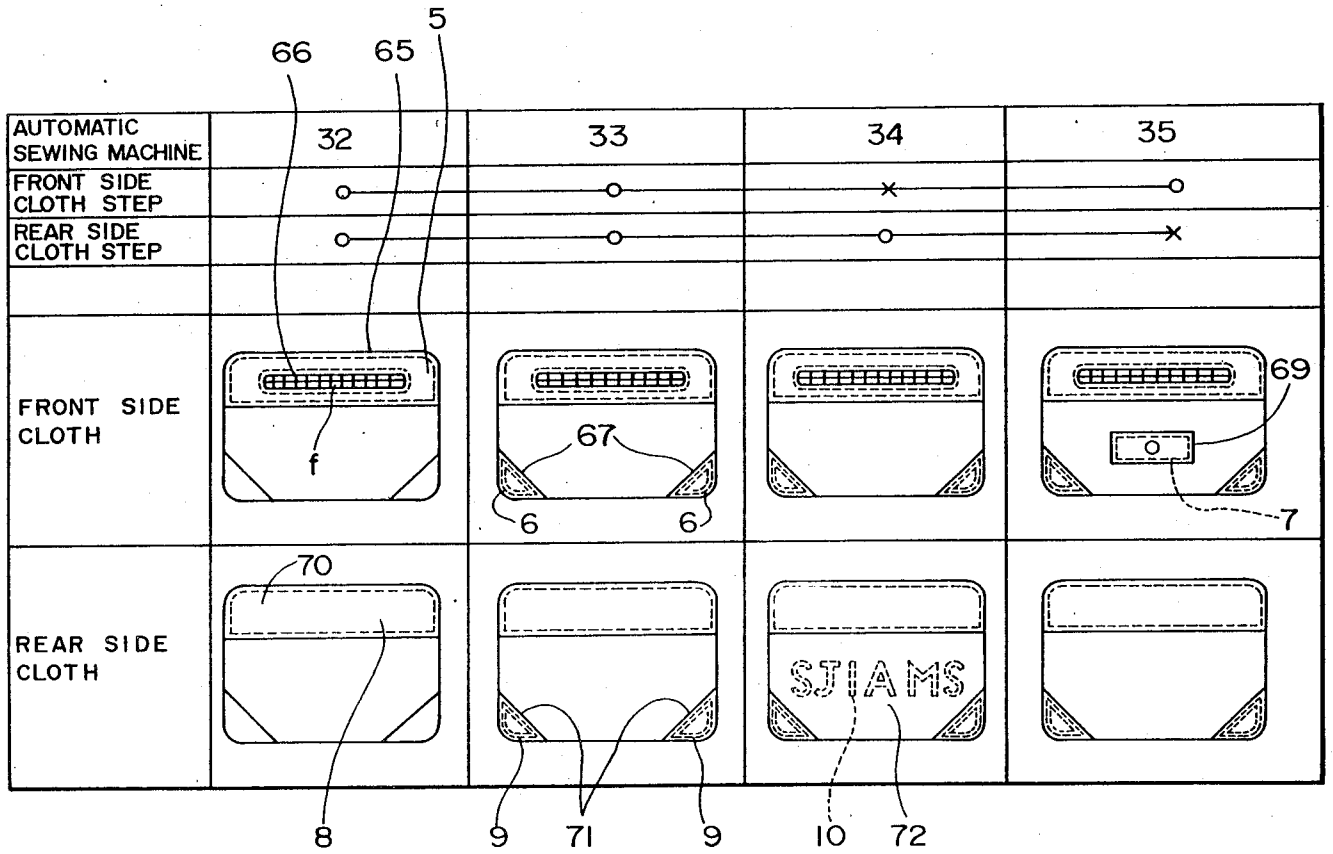
FIG. 11 depicts a sewing pattern of an electronic sewing machine.

The sewing operation for the front side cloth piece 2 will be described firstly with reference to FIG. 11.

The electronic sewing machine 32 performs a sewing step 65 for the cloth piece 5 and a sewing step 66 for the fastener f, while the sewing machine 33 performs sewing steps 67 for the cloth pieces 6 and sewing steps 71 for the cloth pieces 9. The third electronic sewing machine 34 does not perform any sewing step, and the last sewing machine 35 performs a sewing step 69 for the label 7.

As to the sewing operation for the back side cloth piece 3, the sewing machine 32 performs a step 70 for the cloth piece 8, the sewing machine 33 performs sewing steps 71 for the cloth pieces 9, the third sewing machine 34 performs a sewing step 72 for the decorative stitches 10, and the fourth sewing machine 35 does not perform any sewing step.

Figure 12:
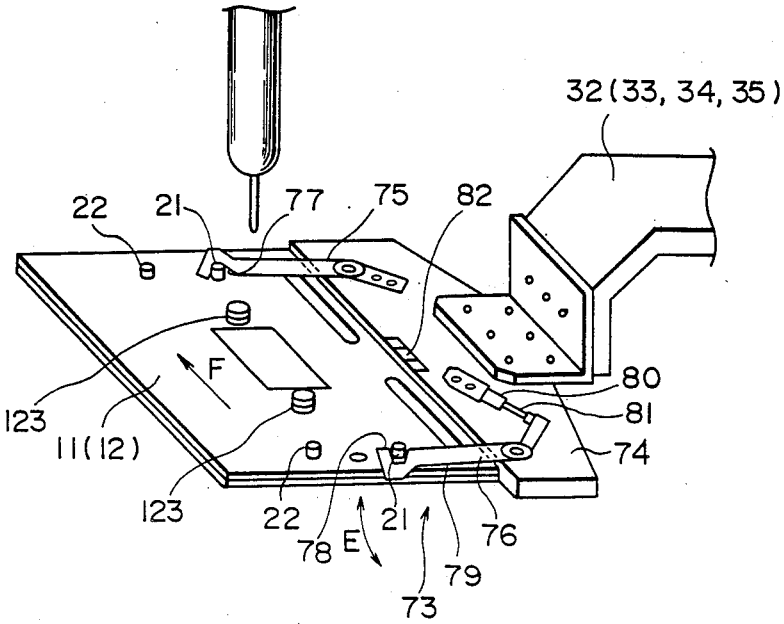
FIG. 12 is a perspective view of a holding portion in the sewing machine side.

In FIG. 12, reference numeral 73 depicts a holding portion provided on a table 74 of each of the electronic sewing machines 32, 33, 34 and 35, the table 74 being moved according to a pattern programmed in the memory such as a PROM. The holding portion 73 is composed of a fixing nail portion 75 and a movable nail portion 76 disposed oppositely to the nail portion 75. The fixing nail portion 75 has one end fixedly secured by a securing pin to the table 74 and the other end formed with a notch 77 facing the movable nail portion 76. The movable nail portion 76 is mounted on the table 74, rotatably in directions shown by an arrow E, and is composed of a nail piece 79 having at a top end a notch 78 facing the notch 77 of the fixed nail portion 75 and an air cylinder 80 fixed on the table 74. The top end of a rod 81 of the air cylinder 80 is rotatably connected to a base end of the nail piece 79. Therefore, when the air cylinder 80 is actuated to extend the rod 81, the nail piece 79 rotates inwardly so that it, together with the fixed nail portion 75, holds the cassette 11 or 12 therebetween. In this case, since the nail portion 75 is fixed, the positioning of the cassette is made exactly. The sewing operations to be made with respect to the cassette are performed on the table 74, which moves two-dimensionally according to the pattern stored in a corresponding sewing machine. Thus, a positioning device for positioning the cassette on the table 74 is constituted with the holding portion 73 and a sensor 82 mounted on the table 74.

Figure 13:
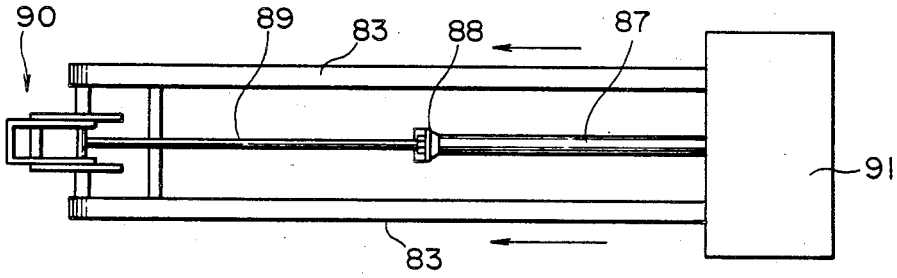
FIG. 13 is a plan view of a carrier device as seen in the direction of an arrow G in FIG. 6.
Figure 14:
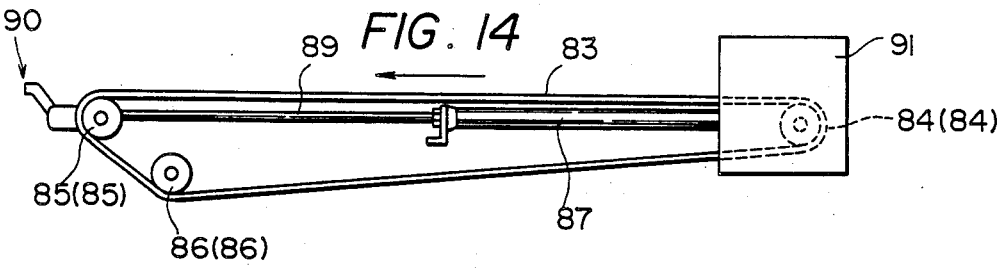
FIG. 14 is a side view of the carrier device of FIG. 13.
Figure 15:
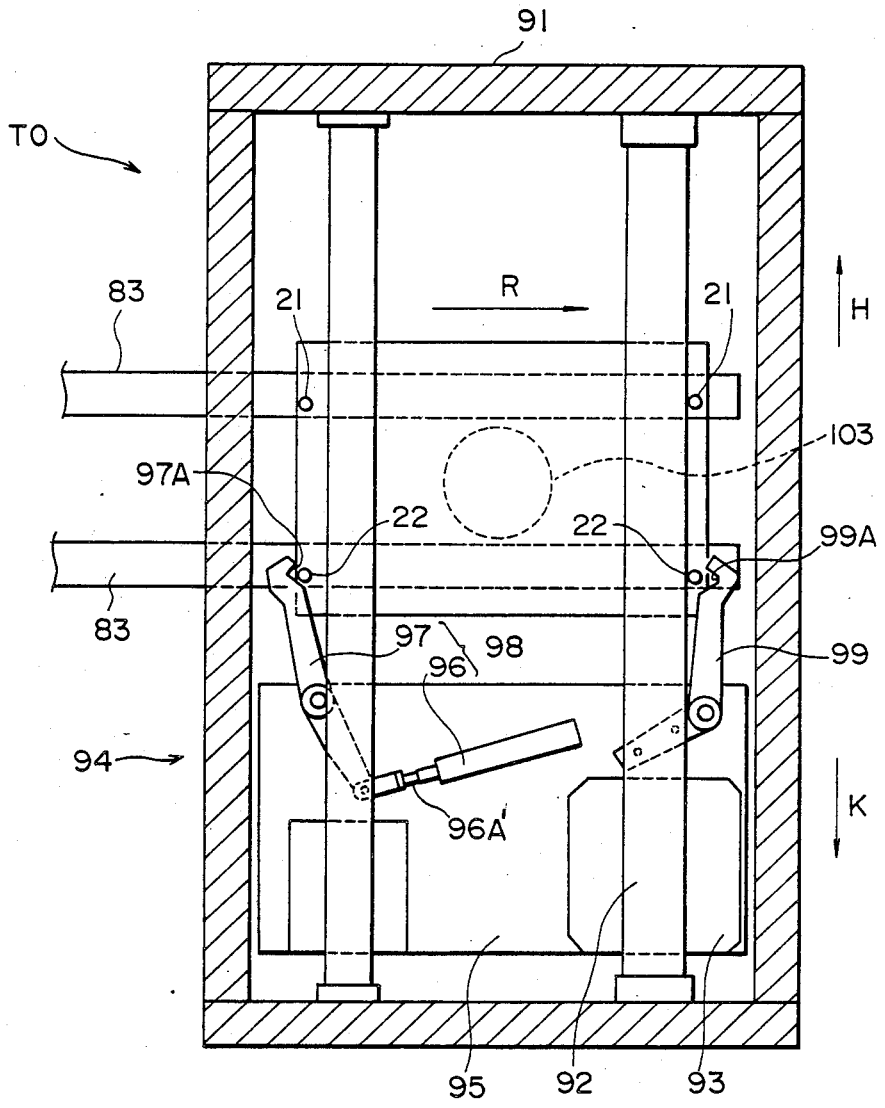
FIG. 15 is a cross-sectional plan view of a feeding unit.
Figure 16:
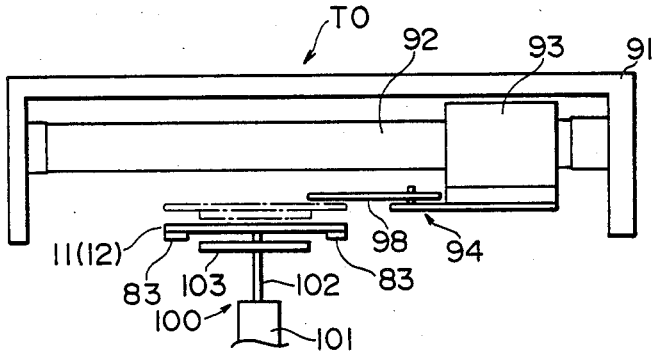
FIG. 16 is a left side view of the unit of FIG. 15.
Figure 17:
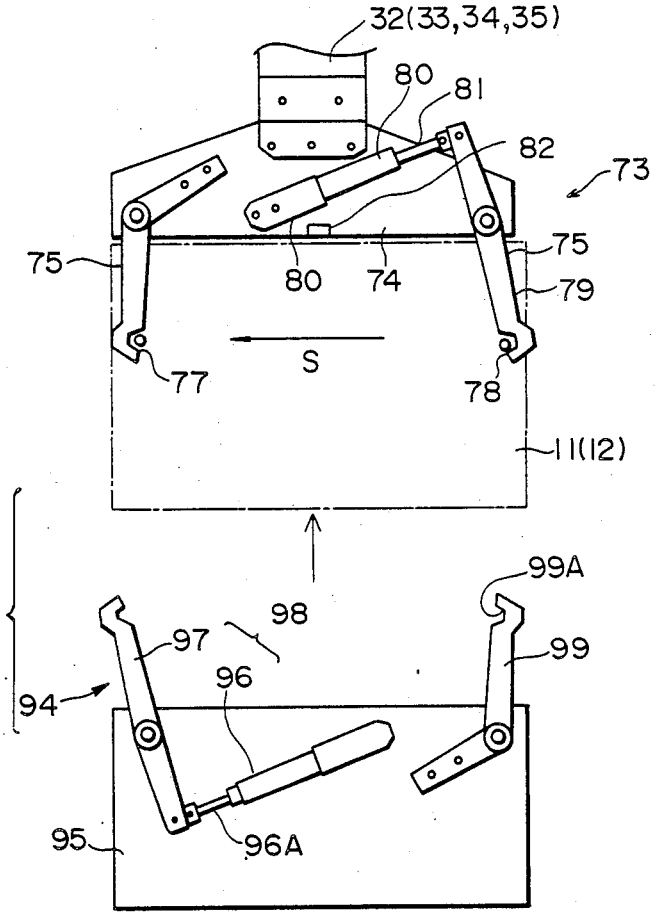
FIG. 17 is a schematic plan view showing a positional relation of the sewing machine.
Figure 18:
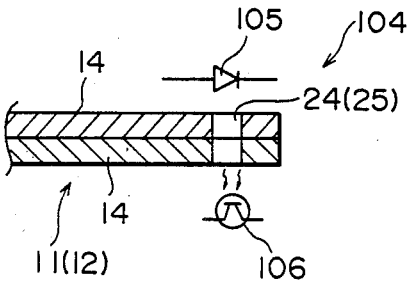
FIG. 18 shows an example of a determination device.

The structure of each of the carrying devices 28 to 31 is shown in FIGS. 13 to 18, of which FIG. 13 is a front view as seen in the direction of an arrow G in FIG. 6, FIG. 14 is a side view thereof, FIG. 15 is an enlarged view of a portion seen in FIG. 14, FIG. 16 left side view, FIG. 17 is a view showing the positional relation of the sewing machines 32 to 35, and FIG. 18 denotes the construction of a sensor.

In FIG. 13, reference numeral 83 depicts carrying conveyers disposed at the downstream side of the conveyer belts 51 of the extracting unit 27 in series with the belts 51. The conveyers 83 are rotatably supported by pulleys 84 and 85, and driving pulleys 86 and run in directions shown by respective arrows to further move the cassette 11 or 12 pushed by the air cylinder 59 of the extracting unit 27. Reference numeral 87 depicts an air cylinder supported by a fixing piece 88. The air cylinder 87 is arranged at the downstream side of the conveyers 83 in parallel therewith, and a rod 89 thereof can be extended in the downstream direction. The rod 89 is provided, at the top end thereof, with a pusher portion 90. Since the structure of the pusher portion 90 is the same as that of the pusher 61 shown in FIGS. 8 to 10, details thereof are omitted here.

Reference numeral 91 depicts a frame arranged such that it covers the upstream end portion of the conveyer belts 83, as shown in FIGS. 13 to 15. Within the frame 91, a so-called rodless cylinder 92 is mounted at the upstream side of the upstream side end of the conveyer belts 83, extending orthogonally thereto. A movable portion 93 of the rodless cylinder 92 is movable orthogonally to the conveyer belts 83 toward the sewing machine 32 . . . or 35 (H direction) or away from it (K direction).

Reference numeral 94 depicts a holding portion mounted on a mounting base 95 of the movable portion 93 of the rodless cylinder 92. The holding portion 94 is constituted by a movable nail portion 98 composed of an air cylinder 96, a nail piece 97 and a fixed nail portion 99. Since the structure of the holding portion 94 is the same as that of the holding portion 73 mounted on the table 74 of the sewing machine, details thereof are omitted here, except to note that the movable nail portion 98 of the holding portion 94 faces the fixed nail portion 75 of the holding portion 73 at the side of the sewing machine and the fixed nail portion 99 of the holding portion 94 faces the movable nail portion 76 of the holding portion 73, as shown in FIG. 17.

In FIG. 16, reference numeral 100 depicts a push-up portion provided below the conveyer belts 83. The push-up portion 100 is constituted by a drive portion 101, a rod 102 vertically driven by the drive portion 101 and a cassette support 103 in the form of a disc mounted on a top end of the rod 102 and facing a lower surface f the cassette 11 or 12 while being transported by the conveyer belts 83.

The cassette push-up portion 100, the air cylinder 96 of the holding portion 94, the movable portion 93 of the rodless cylinder 92 and the holding portion 73 of each sewing machine are ganged with each other. That is, when the sensor (not shown) or the like detects that the cassette 11 or 12 carried by the conveyer belts 83 has reached a predetermined position, a stopper (not shown) prevents the cassette from being further moved while simultaneously the push-up portion 100 is actuated by the sensor to push up the cassette to a level indicated by a dotted line in FIG. 16.

The air cylinder 96 of the holding portion 94 is actuated upon the detection of the completion of a pushing-up operation of the cassette to the predetermined level. In this case, when the rod 96A of the air cylinder 96 is extended, the nail piece 97 is rotated until the notch 97A thereof engages with the protrusion 22 on one side of the cassette 11 or 12 to push it in a direction shown by an arrow R in FIG. 15. Therefore, the protrusion 22 in the other side of the cassette engages with the notch 99A of the fixed nail portion 99 to thereby hold the cassette between the fixed nail portion 99 and the movable nail portion 98.

The movable portion 93 of the rodless cylinder 92 is shifted to the side of the sewing machine when a sensor (not shown) detects that the cassette 11 or 12 is held by the holding portion 94 to transfer the cassette to the sewing machine. When a sewing operation of the latter is completed, the movable portion 93 is shifted again to the sewing machine side to receive the cassette. In this case, in transferring the cassette to the sewing machine side, the holding portion 94 is driven by the rod-less cylinder 92 to the side of the sewing machine and, when the sensor 82 provided on the table 74 detects an edge 200 or 201 of the cassette 11 or 12, the air cylinder 96 of the holding portion 94 is actuated to disengage the nail piece 97 from the protrusion 21, and the cassette is made free by an actuation of the air cylinder 80 in the side of the sewing machine. Thereafter, the protrusions 77 and 78 are engaged with the movable nail portion 76 and the fixed nail portion 75, respectively, to hold the cassette, and then the holding portion 94 is retracted from the sewing machine in a direction K indicated in FIG. 15. Then, the sewing machine operates to sew and, after the sewing operation is completed, the holding portion 94 is shifted again to the sewing machine in a direction H in FIG. 15. At this time, the air cylinder is actuated to disengage the fixed nail portion 75 and the movable nail portion 76 from the protrusions 77 and 78, respectively, to make the cassette free, and then the movable nail portion 97 of the holding portion 94 is actuated to engage with the protrusion 22 to transport the cassette in the direction K.

In this case, since, as shown in FIG. 17, the movable nail portion 73 of the holding portion 73 on the side of the sewing machine 32 faces the fixed nail portion 99 of the holding portion 94 and the fixed nail portion 75 of the holding portion 73 faces the movable nail portion 98 of the holding portion 94, the holding portion 73 receives the cassette (shown by a chain line) while moving it in the direction S, and positioning of the cassette is performed by the fixed nail portion 75.

Further in this case, a sensor 104 (FIG. 18) including a photocoupler, etc., is provided in the vicinity of the conveyer belts 83 as a discriminating device for determining whether the cassette is for the front side cloth piece or the back side cloth piece, controls the driving portion 101 of the push-up portion 100. The sensor 104 is composed of a light-emitting diode 105 and a phototransistor 106 facing one another through the detection hole 24 or 25 of the cassette 11 or 12. The presence of the hole is detected from the output of the transistor 106. The sensor 104 actuates the driving portion 101 of the push-up portion 100 only when the result of the determination indicates necessity of a sewing operation of the sewing machine. That is, for the first sewing machine 32, for example, the push-up portion 100 is actuated for either the cassette 11 or 12 and, for the third sewing machine 34, for example, the push-up portion 100 is actuated only for the cassette corresponding to the back side cloth piece 3. Since this is the same for the subsequent carrying units 29, 30 and 31, respectively, details thereof are omitted.

A device TO for supplying the cassette 11 or 12 to the sewing machine 32, 33, 34 or 35 is constituted by the frame 91, the rodless cylinder 92, the holding portion 94, the mounting plate 95, the movable nail portion 98, the fixed nail portion 99, the cassette push-up portion 100, and the sensor 104. A second carrying unit is constituted by the supply device TO, and the first carrying unit is constituted by the conveyer belts 83 of the carrying devices 28, 29 or 30 preceding the supply device TO.

Figure 19:
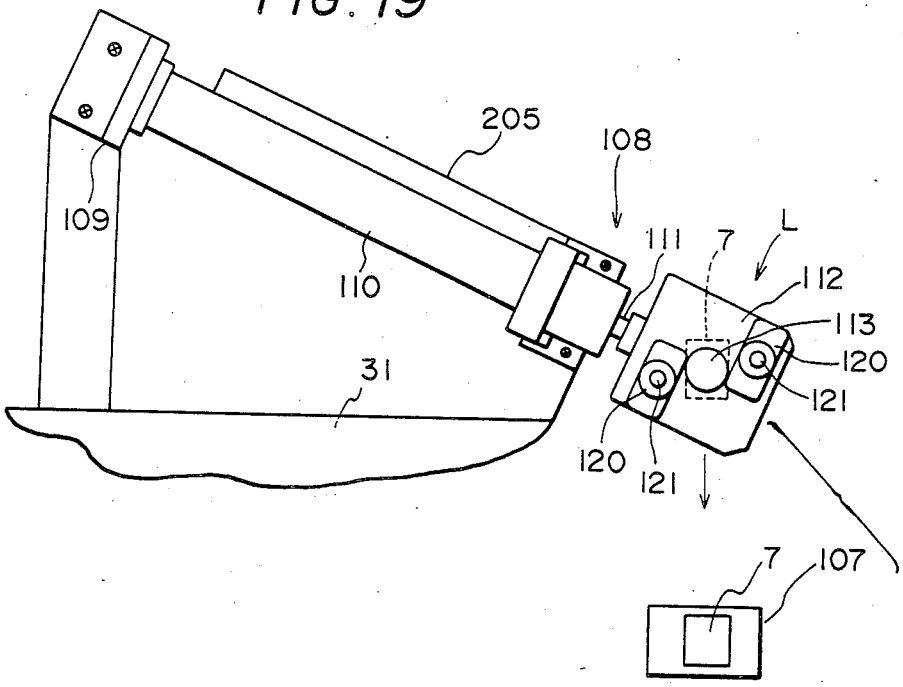
FIG. 19 is a plan view of a supplying device.
Figure 20:
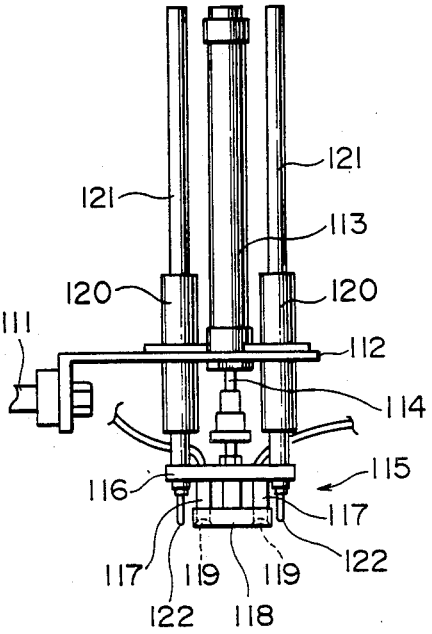
FIG. 20 is a front view of the supplying device in FIG. 19.
Figure 21:
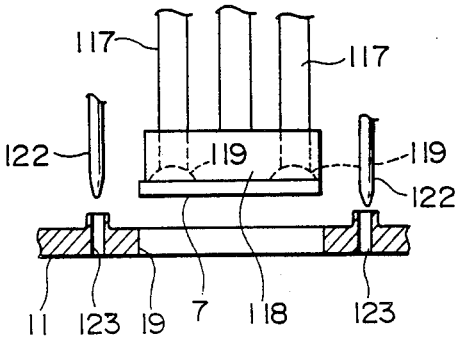
FIG. 21 is an enlarged view of a portion of the supplying device of FIG. 20.
Figure 22:
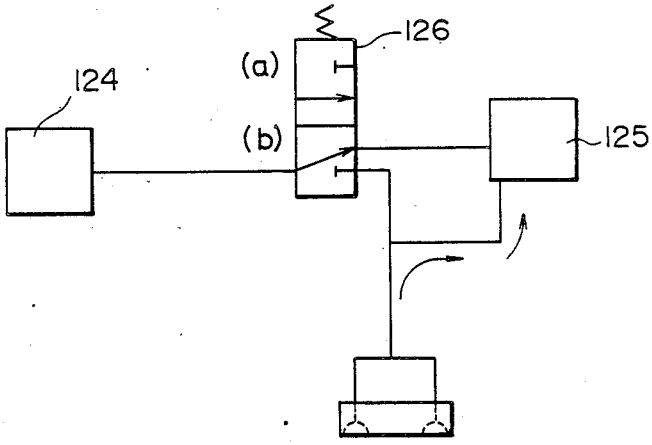
FIG. 22 shows a fluid passage portion.

FIG. 19 to 22 show a label supplying device provided at the side of the fourth sewing machine 35, of which FIG. 18 is a plan view as seen in the direction of an arrow T indicated in FIG. 6, FIG. 22 is a side view as seen in a direction of an arrow L, FIG. 21 is an enlarged view of a portion of FIG. 20, and FIG. 22 shows the construction of a fluid pressure system.

In FIG. 19, the label supplying device is constituted by a holding cylinder 107 having an upper face opening for holding a stack of labels 7 and a working portion 108 for extracting the labels 7 from the holding cylinder 107 one by one and supplying them to the cassette 11 for the front side cloth piece in the fourth sewing machine 35. The working portion 108 is constituted by a horizontal arm 110 mounted on a frame 205 mounted on the carrying unit 31, a movable portion 111 extendable from the arm 110, an air cylinder 113 (FIG. 20) mounted vertically downwardly on a lower surface of a top end portion of the movable portion 111 and having a lower portion supported by a supporting piece 112, and a label holder 115 mounted on a lower end of a rod 114 of the air cylinder 113. The rod 114 reaches above the cassette 11 held by the holding portion 94 of the last carrying unit 31 and the air cylinder 113 reaches above a hole 19 of the cassette 11 when the rod is fully extended.

The label holder 115 is composed of a plate 116 mounted on a lower end of the rod 114 and a suction portion 118 provided through fluid tubes 117 on the plate 116. A pair of recesses 119 are formed on a lower surface of the suction portion 118. The recesses 119 are connected to first ends of the fluid tubes 117 whose other ends are connected to a fluid passage portion (to be described) such that, when the latter is actuated to take in fluid, the label 7 is attracted to the suction portion 118 and, when the fluid passage portion is actuated to discharge, the label 7 is separated from the suction portion 118.

Reference numeral 120 depicts guide tubes supported by the support plate 112 vertically. Each guide tube 120 has a guide rod 121 slidable vertically therethrough. Lower ends of the guide rods 121 are connected to the plate 116 so that the guide rods 121 guide the vertical movement of the rod 114 of the air cylinder 113. Reference numeral 122 depicts positioning pins provided downwardly on a lower surface of the plate portion 116. The positioniong pins 122 extend below the attraction plate 118, and a lower end of each pin 122 is rounded as shown in FIG. 21. The distance between the pins 122 corresponds to the distance between holes 123 formed in both sides of the label hole 19 of the cassette 11 for the front side cloth piece, as shown. The diameter of each pin 122 is substantially the same as the diameter of the hole 123. Therefore, when the rod 114 of the air cylinder 113 is extended downwardly, the pins 122 engage with the holes 123 before the attraction portion 118 of the label holder 115 enters the label hole 19 of the cassette 11 so that exact positioning is performed.

Thus, the pins 122 and the holes 123 constitute the positioning portion.

In FIG. 22 showing the fluid passage portion, reference numeral 124 depicts a compressed air source, 125 a suction source, and 126 a three-way valve. When the valve 126 is in a position b, pressure in the recesses 119 formed in the lower face of the attraction portion 118 of the label holder 115 becomes negative (below atmospheric pressure) due to the suction of the suction portion 124 and thus a label 7 is attracted thereto. On the other hadn, when the three-way valve 126 in a position a, the pressure source 124, is placed in communication with the recesses 119, and thus the label 7 attracted to the attraction portion 118 is released.

Figure 23:
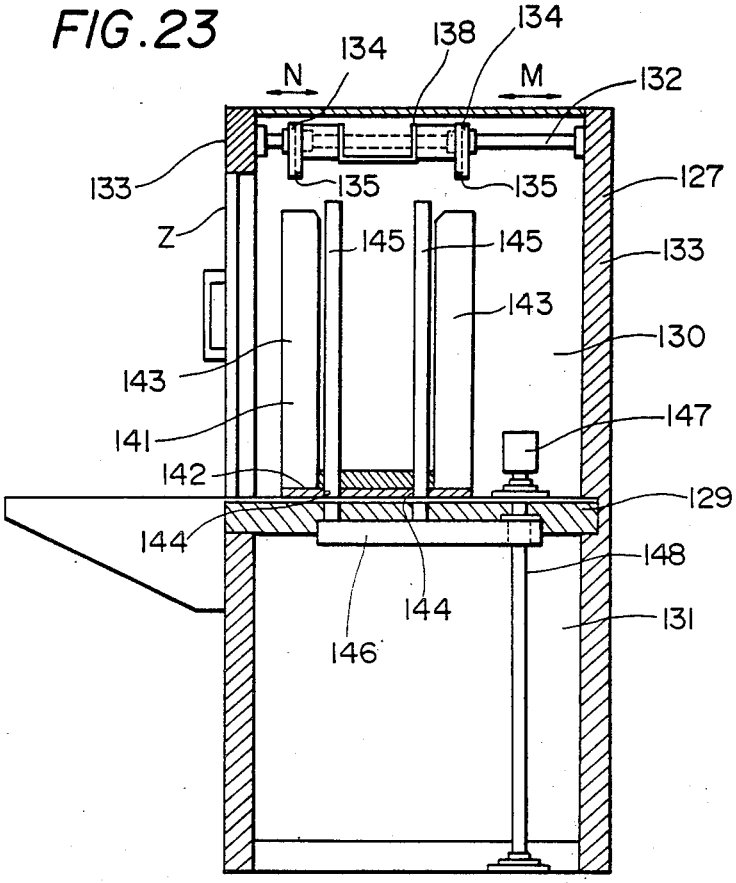
FIG. 23 is a cross sectional taken along a line X—X in FIG. 6.
Figure 24:
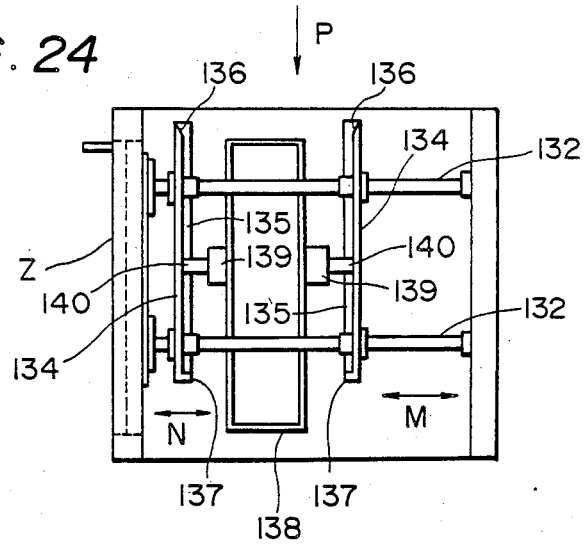
FIG. 24 is an upper view of the portion shown in FIG. 23.

FIG. 23 and 24 show the construction of the extracting and storing unit 36, of which FIG. 23 is a cross section thereof taken along a line X—X in FIG. 6 and FIG. 24 is a plan view thereof.

In these figures, reference numeral 127 depicts a cabinet having a cassette receiving port 128 (FIG. 6) formed in a front side thereof. The cabinet 127 is divided by a mounting plate 129 into an upper chamber 130 and a lower chamber 131. The upper chamber 130 is operable by a door Z provided on one side wall of the cabinet 127.

Reference numeral 132 depicts a pair of guide rods provided between respective side plates 133 of the cabinet 127. A pair of cassette holding members 134 are supported by the guide rods 132 slidably in directions N and M, respectively, as shown, so that the members 134 can be moved toward and away from each other to thereby pinch therebetween a cassette 11 or 12 transported in a direction P. The members 134 have cassette holding portions 135 in the form of the letter L and a reversed letter L in cross section with bottom pieces of the L and the reversed L protruding inwardly, as shown in FIG. 23, upstream end portions 136 of top ends of the letter L and the reversed L being tapered to facilitate reception of the cassette, as shown in FIG. 24. Downstream end portions are bent inwardly to form stoppers 137 for stopping further movement of a received cassette 11 or 12.

Reference numeral 138 depicts a fixed portion disposed between the cassette holding members 134. A pair of air cylinders 139 are mounted oppositely on the fixed portion 138. A rod 140 of one of the air cylinders 139 is connected to one of the cassette holding members 134, and a rod 140 of the other air cylinder 139 is connected to the other cassette holding member 134, as shown in FIG. 24, so that the cassette holding members 134 can move in the arrow-indicated directions N and M, respectively, whereby the distance between the cassette holding members 134 when the rods 140 are retracted completely corresponds to the width of the cassette 11 or 12 and, when the rods 140 are fully extended, it becomes wide enough to allow the cassette to drop.

Reference numeral 141 in FIG. 23 indicates a cassette receiving frame disposed on the mounting plate 129 in a position just below the cassette holding members 134. The frame 141 is composed of a bottom plate 142, having substantially the same size and configuration as the cassette, and four frame pieces 143 extending upwardly from the four corners of the base plate 142. Each of the frame piece 143 is in the form of the letter L in cross section. The base plate 142 is formed with a pair of holes 144.

Reference numeral 145 depicts a pair of cassette support members extending vertically movably through the corresponding ones of holes 144. Upper ends of the cassette support members 145 are at substantially the same level as that of the frame piece 143 of the frame 141 at its highest position. Lower ends of the members 145 are fixed to a mounting plates 146 having a threaded hole through which a drive shaft 148 of a drive portion 147 extends. The drive shaft 148 is in the form of lead screw which meshes with the thread of the threaded hole so that, when the drive portion 147 drives the drive shaft 148, the mounting plate 146 is moved vertically. The drive portion 147 is controlled such that in a downward stroke of the mounting plate 146 it moves steppingly with an increment corresponding to the thickness of the cassette. The length of the member 145 is set such that when the mounting plate 146 reaches the lowermost position, the members 145 are out of the cassette holding frame 141. Thus, in FIG. 23, cassettes 11 or 12 come down from the cassette holding portions 135 one by one and are received by the top ends of the members 145 while the latter moves down steppingly. Since the members 145 are out of the frame 141 at the lowest position thereof, the cassettes are left in stack in the frame 141. The latter can be removed from the cabinet through the door 132.

Figure 25:
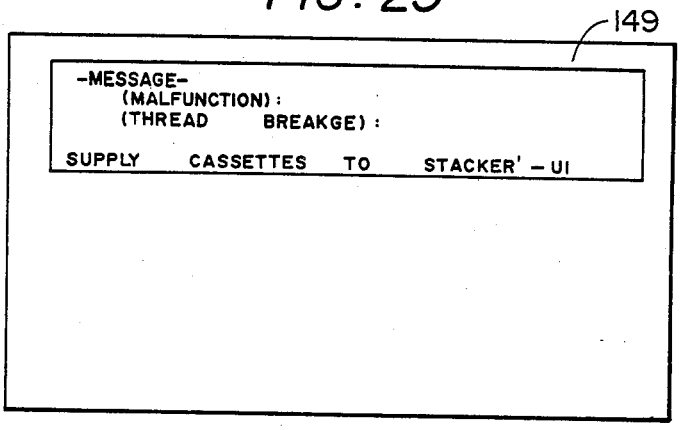
FIGS. 25 to 27 show examples of a CRT display.
Figure 26:
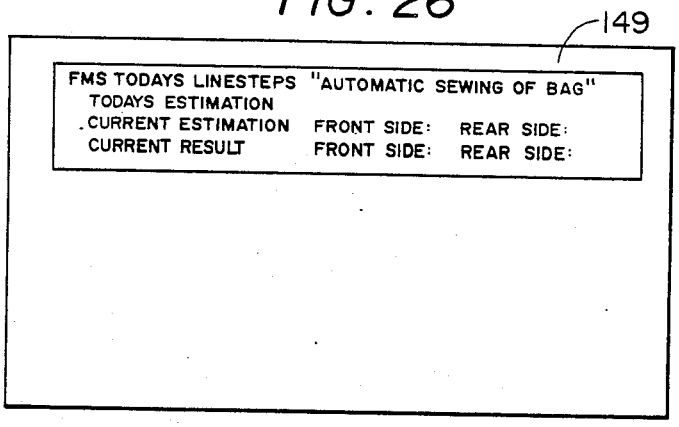
Figure 27:
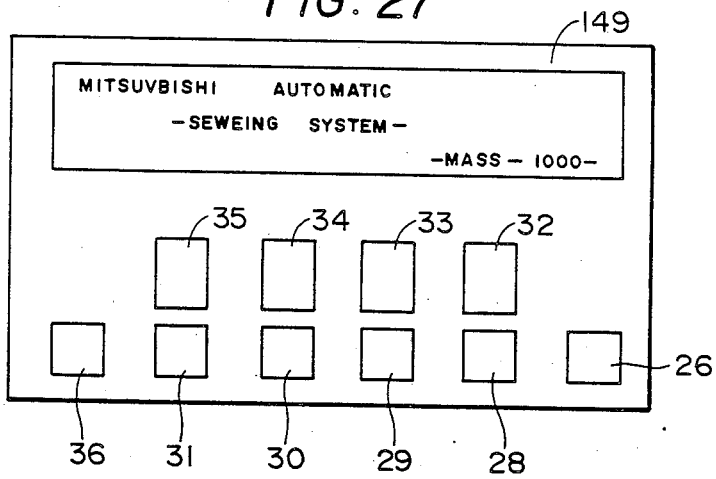

A signal input portion (not shown) for receiving signals indicative of the aforementioned various statuses of the units and a CRT 149 for displaying these statuses are provided. The signal input portion is supplied with a signal from a sensor (not shown) provided on the frame 141 which is indicative of the number of cassettes in the frame, signals from sensors (not shown) provided on the respective units 26, 27 etc. indicative of erroneous operations thereof, and signals from sensors (not shown) provided on the respective electronic sewing machines 32 . . . 35 indicative of the breakage of the sewing threads. The CRT 149 displays the statuses of the respective units and sewing statuses according to these signals as shown in FIGS. 25 to 27.

The operation of the present automatic sewing apparatus constituted as above will be described.

The front side cloth piece 2, the cloth pieces 5 and 6, the fastener f, and the label 7 are set on the cassette 11, or the back side cloth piece 3 is set on the cassette 12, together with the cloth pieces 8 and 9. The cassettes 11 or 12 having the various cloth pieces, etc., are set in the support frame 38 of the supply unit 26.

Then, upon actuation of a start switch, the air cylinders 55 of the extracting unit 27 are actuated to remove the cassettes one by one from the unit 26 and place them on the conveyer belts 51. The cassettes on the conveyer belts 51 are transported to the downstream end of the unit 27 and then pushed by the air cylinder 59 downwardly into the transporting unit 28.

Upon this action, the push-up portion 100 of the unit 26 is actuated to push up the cassette which is then held by the cassette holding portion 94 and transported to the sewing machines 32 by the rodless cylinder 92. The sensor 82 detects the above fact to actuate the cassette holding portion 73 of the sewing machine 32 to thereby hold the cassette after the latter is released from the cassette holding portion 94. Then, the latter is retracted and the sewing machine 32 is actuated to sew as instructed. Upon the completion of the sewing operation of the sewing machine 32, the rodless cylinder 92 is shifted again to the sewing machine 32 and, after the holding portion 73 of the sewing machine releases the cassette, the cassette holding portion 94 holds the cassette, returns to the original position, and releases the cassette. Then, when the push-up portion 100 is lowered, the cassette is placed on the conveyer belts 83 and transported thereby downwardly. A similar operation is done in the subsequent carrying device 29 upon actuation of the air cylinder 87. In this case, the cassette passes through the sewing machines in which no sewing operation is to be done.

Thereafter, when the cassette 11 is held by the holding portion 94 of the fourth sewing machine 35, the label supply device is actuated. In this case, the attraction portion 118 of the label holder 115 attracts one of the labels 7 stacked in the holding cylinder 107, extends the movable portion 111 thereof, and sets the label 7 on the label mounting hole 19 of the cassette 11. At this time, since the engaging rods 122 of the operating portion 108 engage with the positioning holes 123 in both sides of the hole 19, the cassette 11 can be positioned exactly on the hole 19. Then, the holding portion 94 transports the cassette to the sewing machine 35 in which the label 7 is attached to the cloth piece 2 by the latter machine.

A cassette 11 for which the sewing operation is completed is held by the holders 134 of the unit 36 as shown in FIG. 23 and then dropped onto the upper ends of the support members 145. Since the latter members are lowered steppingly with an increment corresponding to the thickness of the cassette, a predetermined number of the cassettes can be stored in the stack in the cassette holding frame 141 and can be taken out from the cabinet through the door 132 thereof.

When any of the units malfunctions or there is any thread breakage during the sewing operation, such fact is displayed on the CRT 149. The number of the cassette in the frame 141 is also displayed on the CRT 149.

Figure 28:
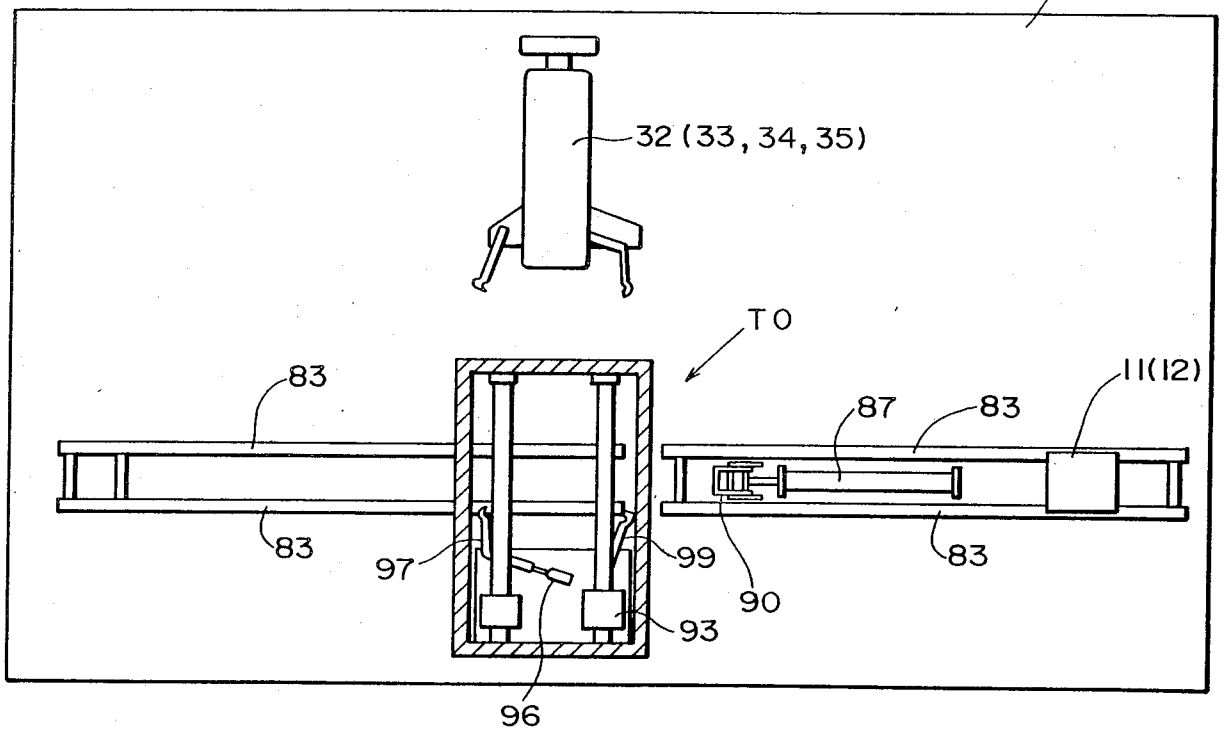
FIG. 28 is a plan view of a portion of another embodiment.

FIG. 28 shows the sewing machines 33 through 35, the feeding unit TO, the conveyer belts 83 disposed at the upstream side of the unit TO, the air cylinder 87, the pusher portion 90, and the conveyer belts 83 disposed at the downstream side of the unit TO blocked in a frame 150 of the sewing machines. In this embodiment, the cassettes 11 or 12 are placed on the upstream side conveyer belts 83 manually and the cassettes for which the sewing operations are completed are removed manually from the downstream side conveyer belts 83.

As described hereinbefore, according to the present invention, the inventive automatic sewing apparatus includes a cassette for positioning and holding materials to be sewn, the cassette being provided with a determination portion, a table for mounting the cassette thereon, the table being movable according to a program of a sewing pattern, a plurality of units arranged in series, each of the units having a sewing machine for sewing the materials held by the cassette, a first carrier unit for transporting the cassette in a downstream direction, and a second carrier unit disposed at an end of the first carrier unit for moving the cassette to the sewing machine for sewing the materials thereon and for carrying away the cassette from the sewing machine after a sewing operation terminates. Sewing pattern programs of the respective units are different from each other so that a plurality of sewing steps can be done. A determination device is provided in the second carrier unit to identify the determination portion of the cassette, the second carrier unit positioning the cassette in the sewing machine according to the output of the determination device. With this arrangement, automatic sewing operations can be performed by merely placing the cassette in the first carrier unit under the control of the controller, and a variety of sewing operation can be performed.

We claim:

1. An automatic sewing apparatus comprising: at least one cassette for positioning and holding materials to be sewn, a plurality of sewing machines each having a table movable according to a program of a sewing pattern, said cassette being selectively mounted on said table, a plurality of first carrier units each for transporting said cassette in a predetermined direction, and a plurality of second carrier units each for transporting said cassette transported by said first carrier unit to a corresponding one of said sewing machines and then for transporting said cassette in a predetermined direction, a plurality of sewing units thereby being formed each including one of said sewing machines, one of said first carrier units and one of said second carrier units, said sewing units being arranged in series, said sewing machines having different programs of sewing patterns, respectively, so that said sewing machines perform different sewing operations on said materials held in said cassette sequentially.

2. The apparatus as claimed in claim 1, further comprising a control unit for controlling said transportation of said cassette and operations of said sewing machines.

3. The apparatus as claimed in claim 1, wherein said cassette comprises a pair of flaps between which said materials are pinched, said flaps having openings in positions corresponding to positions to which sewing operation are to be performed.

4. The apparatus as claimed in claim 3, wherein said flaps have edges hinged together.

5. The apparatus as claimed in claim 1, wherein said cassette has at least one window through which a separate material to be sewn to said materials is insertable.

6. The apparatus as claimed in claim 1, wherein said first carrier unit comprises a conveyor belt for transporting said cassette and an engaging member provided on said conveyor belt selectively engageable with said cassette to extract ones of said cassette one by one.

7. The apparatus as claimed in claim 1, further comprising pusher means provided at a downstream side of said first carrier unit pushing ones of said cassette to said second carrier unit one by one.

8. The apparatus as claimed in claim 1, wherein said sewing machine comprises means having a memory element for storing a different sewing pattern and means for positioning said cassette on said table for a sewing operation of the stored pattern.

9. The apparatus as claimed in claim 8, whrein said table comprises a movable nail selectively engageable with said cassette and means for driving said movable nail.

10. The apparatus as claimed in claim 1, wherein said second carrier unit comprises a conveyor for transporting said cassette from said first carrier unit, means for moving said cassette upwardly from said conveyor when said cassette reaches a predetermined position on said conveyor, means for holding said cassette moved upwardly and driving means for moving said holding means to said table.

11. The apparatus as claimed in claim 10, wherein said second carrier unit comprises means for moving said holding means to said table again after a sewing operation of said sewing machine has been completed and separating and returning said cassette from said table to said conveyor.

12. The apparatus as claimed in claim 1, wherein said cassette comprises an indentification portion, and said second carrier unit comprises means responsive to a status of said identification portion to distinguish whether said cassette is to be moved to said table for a sewing operation or to be transported downstream without a sewing operation.

13. The apparatus as claimed in claim 1, further comprising a cassette feeding unit disposed at an upstream side of said first carrier unit of a most upstream one of said sewing units for storing a plurality of said cassettes, and wherein said first carrier unit comprises an engaging member selectively engageable with said cassettes in said cassette feeding portion to extract ones of said cassette from said cassette feeding portion one by one.

14. The apparatus as claimed in claim 1, further comprising label feeding means for feeding small-sized label materials to be sewn on said materials to said cassettes.

15. The apparatus as claimed in claim 14, wherein said cassette has at least one window through which a separate material to be sewn to said material is insertable.

16. The apparatus as claimed in claim 14, wherein said cassette has at least one window through which a separate material to be sewn to said materials is insertable and positioning holes for recieving engaging members provided on a label holding portion of said label feeding means during a label feeding period.

17. The apparatus as claimed in claim 1, further comprising a cassette recovering unit provided at a downstream side of a most downstream one of said sewing units for storing in a stack ones of said cassette moved from said second carrier unit successively.

18. The apparatus as claimed in claim 2, wherein said control unit comprises display means for displaying at least one of operating conditions of said sewing units and a number of products produced by sewing operations in said sewing units.

* * * * *